US007140451B2

(12) United States Patent
Yoshimizu et al.

(10) Patent No.: US 7,140,451 B2
(45) Date of Patent: Nov. 28, 2006

(54) PORTABLE TOOL HAVING COVER AND LABEL TO BE STUCK ON THE PORTABLE TOOL FOR IDENTIFICATION

(75) Inventors: Chikai Yoshimizu, Hitachinaka (JP); Masato Sakai, Hitachinaka (JP); Toshiaki Mashiko, Tokyo (JP); Mikio Kitao, Tokyo (JP); Yoshihiro Komuro, Hitachinaka (JP); Jyunichi Suzuki, Hitachinaka (JP); Takeshi Taniguchi, Hitachinaka (JP); Kazuhisa Hashimoto, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 164 days.

(21) Appl. No.: 10/722,462

(22) Filed: Nov. 28, 2003

(65) Prior Publication Data

US 2004/0111933 A1 Jun. 17, 2004

(30) Foreign Application Priority Data

Nov. 28, 2002 (JP) ..... P2002-346212
Feb. 20, 2003 (JP) ..... P2003-043350

(51) Int. Cl.
*B25C 7/26* (2006.01)

(52) U.S. Cl. ..... 173/217; 173/171; 173/162.2; 227/156; 227/130

(58) Field of Classification Search ..... 227/130, 227/156; 173/171, 217, 162.2; 150/154, 150/161, 162; 40/913, 626, 629; 116/200
See application file for complete search history.

(56) References Cited

U.S. PATENT DOCUMENTS

| | | | | |
|---|---|---|---|---|
| 2,202,253 | A * | 5/1940 | Hiatt | 40/913 |
| 4,981,247 | A * | 1/1991 | Noll | 227/156 |
| 5,024,014 | A * | 6/1991 | Swierczek | 40/913 |
| 5,025,970 | A * | 6/1991 | Anderson et al. | 227/156 |
| 5,168,600 | A * | 12/1992 | Huang | 40/660 |
| 6,263,599 | B1 | 7/2001 | Matthews | |
| 6,615,518 | B1 * | 9/2003 | Pia et al. | 40/913 |

* cited by examiner

*Primary Examiner*—John Sipos
*Assistant Examiner*—Michelle Lopez
(74) *Attorney, Agent, or Firm*—Antonelli, Terry, Stout and Kraus, LLP.

(57) ABSTRACT

A portable tool includes a motive power section, a mechanical section driven by the motive power section, and an outer frame covering the motive power section and the mechanical section. A label or a sticker is affixed to an outer peripheral surface of the outer frame. The label contains specific pattern or specific color or specific character representing a specific user of the portable tool. The cover is made from a transparent resin and is removably disposed to the outer frame for protectingly covering the label. A sheet containing a plurality of labels having colors or pattern different from each other is provided. A user can select one of the labels.

24 Claims, 15 Drawing Sheets

PORTABLE TOOL HAVING COVER AND LABEL TO BE STUCK ON THE PORTABLE TOOL FOR IDENTIFICATION

BACKGROUND OF THE INVENTION

The present invention relates to a cover or a protector for a portable tool, a combination of a portable tool and a cover, and a combination of a portable tool, a cover and a label or a sticker to be stuck on the tool for identification. More particularly, the present invention relates to a cover and a sticker to be stuck on an outer frame of a portable tool, such as an electric drill, an electric miter saw, and a pneumatically driven tool, such as pneumatic nail gun. The present invention also relates to a supplying method for supplying the sticker or the label and a printing method for printing the sticker or the label that can be observed through an internet and can be downloaded for printing. Here, the sticker or the label is adapted to be inserted between the outer frame of the tool and the cover disposed thereover.

Conventional portable tools include electric drills, electric round saws, pneumatic nail guns, cordless impact drivers that can be used for screw driving operations on building sites as described in Japanese Patent Application Laid-Open Publication No. 2000-337328 and electric hammers as described in Japanese Patent Application Laid-Open Publication No. Hei 8-229850.

As shown in FIG. 18, a conventional cordless impact driver 501 has a substantially T-shaped overall profile, and includes a motive power section, a mechanical section and a front-end tool section, those being installed in an outer frame 514. The front-end tool section is positioned close to a front end of the impact driver 501. The cordless impact driver is additionally provided with a battery pack 520 accommodating therein a battery such as NiCd cells or nickel/hydrogen cells. The battery pack 520 is covered by an outer frame 522. The motive power section includes a drive motor (not shown), and the mechanical section includes gears (not shown). The front-end tool section includes a drive shaft (not shown) and a hammer (not shown). The drive force from the motive power section is decelerated by the mechanical section and the decelerated rotation is transmitted to the drive shaft to cause the hammer to perform repeated rotation and impacting operation so as to fasten a screw by a bit provided at a front end of an anvil (not shown).

The outer frame 514 includes a resin section 514A made of nylon resin and a hammer case 514B which is a die-casting product made of aluminum alloy for ensuring mechanical strength. The power source, the motive power section and the mechanical section are covered by the resin section 514A, whereas the front-end tool section is covered by the hammer case 514B. The resin section 514A and the hammer case 514B have respective pairs of screw seats 514C, 514D that protrude radially outwardly from the outer frame 514, so that the resin section 514A and the hammer case 514B are secured to each other as screws are fastened into the screw seats 514C, 514D.

A plurality of workers often use impact drivers of the same kind on the same building site. Here, sizes and external designs of the portable tools resemble to each other in spite of the difference in manufacturers. Therefore workers may feel it difficult to accurately identify his own tool. Particularly, it will be extremely difficult to identify his tool among tools those being produced by the identical manufacturer. Therefore, it is a general practice that users of tools working on building sites paint the outer frames 514 of their own tools and/or write their own names on the outer frames 514 as precautionary measure for preventing the tools from being mistakenly used by others or from being stolen.

However, if the outer frame 514 of a tool is painted and the screw fastening work is performed near a white colored wall, for instance, the painted outer frame 514 can be rubbed against the white wall and the paint can be scraped off to stain the white wall. Particularly, in the case of the cordless impact driver 501 in which the screw seats 514C, 514D protrude radially outwardly from the outer frame 514, the screw seats 514C, 514D are prone to be rubbed against a wall on the building site as shown in FIG. 19. Then, if the outer surface of the screw seats 514 are painted, the paint can easily be transferred to the wall. Additionally, the screw seats 514C, 514D may damage to the wall due to the rubbing contact therewith.

Besides, portable tools are often handled coarsely on building sites and, therefore, they may often be scarred and/or stained. Then, the paint or the name put on the outer frame may come off. As a result, users may feel it difficult to identify their own tools. Additionally, such scarred and/or stained tools may degrade external appearance of the tools.

Further, when a portable tool is used for years, a user may be tired of the design of the paint. However, repainting is painstaking, so that the user may not positively remake the paint design.

When a portable tool is used for years, a user may be tired of seeing the drawing of the paint. However, it is a painstaking operation to repaint the outer frame so that the user may not positively remake the drawing.

This problem may be dissolved if the manufactures provide portable tools of the same sort whose outer frames are painted in different colors. Then, however, the manufacturing cost may be increased and delivery or distribution control to such tools may become difficult. As a matter of fact, some manufactures market portable tools of the same sort that are painted in different colors but the number of colors used for painting outer frames is limited to two or three because of the above described problems.

To overcome the above-described drawbacks, one conceivable way is to supply a cover to be covered over the outer frame. The cover is subjected to painting or printing for easy identification of a portable tool. However, the ink on the cover may adhere to and stain the wall as in the case of conventional portable tools.

In an alternative way, manufactures produce various types of covers with a number of different colors and patterns so that each user can select color and/or pattern of the cover. However, supplying such covers will be costly unless there is a strong demand for covers of each color and each pattern.

SUMMARY OF THE INVENTION

In view of the above described circumstances, it is an object of the present invention to provide a cover for a portable tool, a combination of a portable tool and a cover, a combination of a portable tool, a cover and a label or sticker that are provided by the manufacturer at low cost and allow a user to color the outer frame of the portable tool to identify his or her own portable tool and satisfy his or her liking but do not give rise to a risk of staining the object of machining and/or damaging the colored image if the tool is roughly treated.

Another object of the present invention is to provide a system for providing a label or sticker for a portable tool that allows the user to color variously the outer frame of the portable tool to identify his or her own portable tool and aesthetically satisfy his or her liking and, if necessary, put personal information on the portable tool at low cost for both the user and the supplier.

These and other objects of the present invention will be attained by a cover for use in combination with a label and a portable tool including a motive power section, a mechanical section driven by the motive power section, and an outer frame covering at least the motive power section and the mechanical section The outer frame has an outer peripheral surface on which the label is mountable. The cover is made from a light transmissive material and is removably disposed to the outer frame for protectingly covering an entirety of the label and at least a part of the outer frame.

In another aspect of the invention, there is provided a combination of the cover and the portable tool. In still another aspect of the invention, there is provided a combination of the cover, the portable tool and the label.

In still another aspect of the invention, there is provided a method of printing a label for a portable tool including providing step, selecting step, transmitting step, producing step, second transmitting step, and printing step. In the providing step, a plurality of label images having patterns different from each other is provided from a server to a user terminal through an internet for inspecting the plurality of label images at the user terminal. The servers stores therein data of the plurality of label images. In the selecting step, one of the label images among the plurality of label images is selected, and characters to be added to the selected label image is input to produce a selected image information and character information at the user terminal. In the transmitting step, the selected image information and the character information are transmitted from the user terminal to the server. In the producing step, a specific image data based on the selected image information and the character information is produced at the server in such a manner that the characters based on the character information is positioned within a contour of an image based on the selected image information. In the second transmitting step, the specific image data is transmitted from the server to the user terminal for a review for a user. In the printing step, a specific image based on the specific image data is printed at the user terminal.

In still another aspect of the invention, there is provided a method for providing label data for a portable tool with a cover covering an outer frame of the portable tool. The cover is made from a light transmissive material. The providing method includes transmitting step, selecting step, outputting step, and producing step. In the transmitting step, a plurality of images of labels which will be disposed between the outer frame and the cover are transmitted from a server through an internet to a user terminal. The plurality of images have patterns different from each other. In the selecting step, one of the plurality of label images is selected and characters are inputted at a user terminal while observing at the user terminal the plurality of image data transmitted to the user terminal. A selected image information and character information are produced at the user terminal. In the outputting step, the selected image information and the character information are output from the user terminal to the server. In the producing step, a specific image data based on the selected image information and the character information are produced and transmitted from the server to the user terminal. Characters based on the character information are positioned within a contour of an image based on the selected image information. A specific image based on the specific image data is printed at the user terminal.

In still another aspect of the invention, there is provided a server for providing label data for a portable tool with a cover covering an outer frame of the portable tool. The cover is made from a light transmissive material. The server includes a first storage region, a second storage region, a third storage region, and a fourth storage region. The first storage region stores data of a plurality of images of labels which will be disposed between the outer frame and the cover. The plurality of images have patterns different from each other. The second storage region stores a program for selecting one of the plurality of label images and for inputting characters at a user terminal while observing at the user terminal the plurality of image data transmitted to the user terminal through an internet. A selected image information and character information are produced at the user terminal. The third storage region stores a program for outputting the selected image information and the character information from the user terminal to the server. The fourth storage region stores a print data production program for producing and transmitting to the user terminal a specific image data based on the selected image information and the character information. Characters based on the character information are positioned within a contour of an image based on the selected image information. A specific image based on the specific image data is printed at the user terminal.

DETAILED DESCRIPTION OF THE PREFERRED EMBODIMENTS

Figure 1:
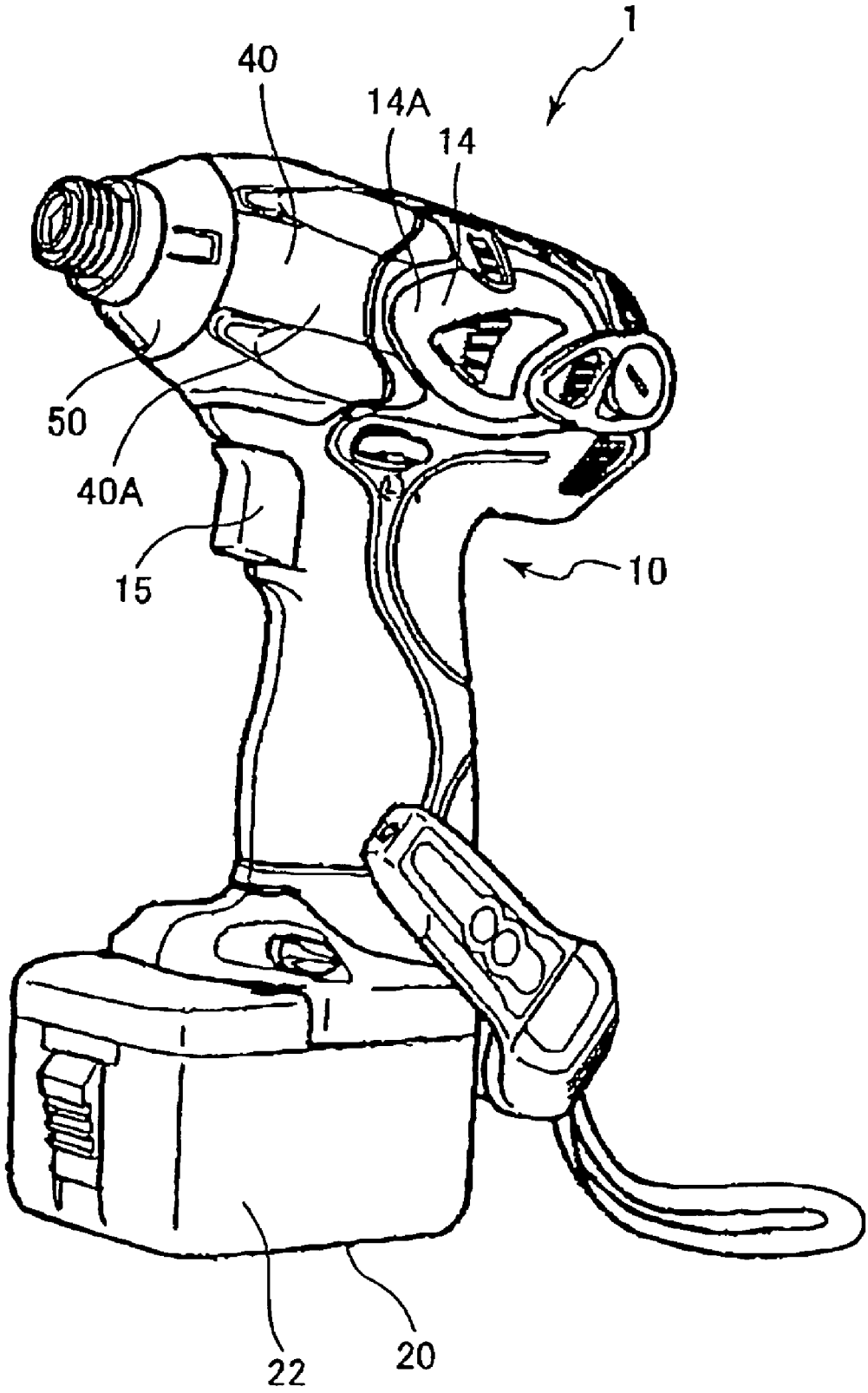
FIG. 1 is a perspective view showing a portable tool according to a first embodiment of the present invention.
Figure 2:
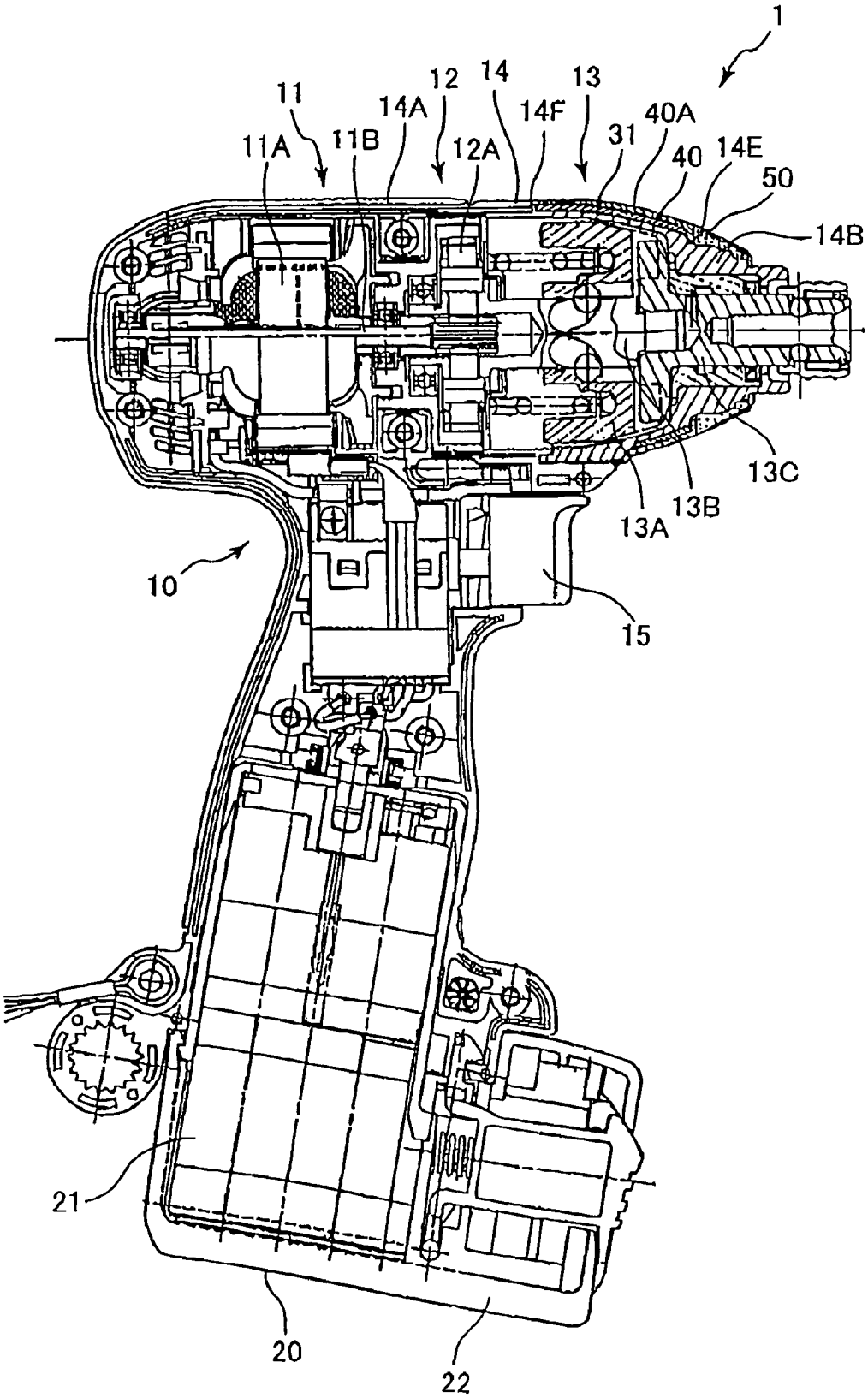
FIG. 2 is a cross-sectional view showing the portable tool of FIG. 1.

A portable tool, a cover, a label, and a combination thereof according to a first embodiment of the present invention will be described with reference to FIGS. 1 through 4. The portable tool 1 is a cordless impact driver powered by electricity supplied from a battery 21 (FIG. 2). As shown in FIGS. 1 and 2, the cordless impact driver 1 includes a main body 10 provided with a motive power section 11, a mechanical section 12 and a front-end tool section 13, and a battery pack 20 provided with a battery 21 such as NiCd cells and nickel/hydrogen cells. The motive power section 11, the mechanical section 12 and the front-end tool section 13 of the main body 10 are covered by an outer frame 14, whereas the battery 21 is covered by an outer frame 22 to constitute the battery pack 20. The battery pack 20 is detachably assembled to the main body 10.

The motive power section 11 is provided with a motor 11A (FIG. 2) driven by electric power supplied from the battery 21. The outer frame 14 is provided with a switch 15 for starting and stopping the motor 11A. The mechanical section 12 includes reduction gears 12A connected to an output shaft 11B of the motor 11A The reduction gears 12A is driven by the motor 11A and decelerated rotation is transmitted to the front-end tool section 13. The front-end tool section 13 includes a hammer 13A, a spindle 13B and an anvil 13C. The spindle 13B is connected to the reduction gears 12A and the hammer 13A. The hammer 13A has a pawl section to which the anvil 13C is connected. A bit (not shown) is removably fitted to the front end of the anvil 13C. The rotation of the reduction gears 12A is transmitted sequentially to the spindle 13B, the hammer 13A and the anvil 13C in the mentioned order so that the screw is fastened by way of the bit.

Figure 3:
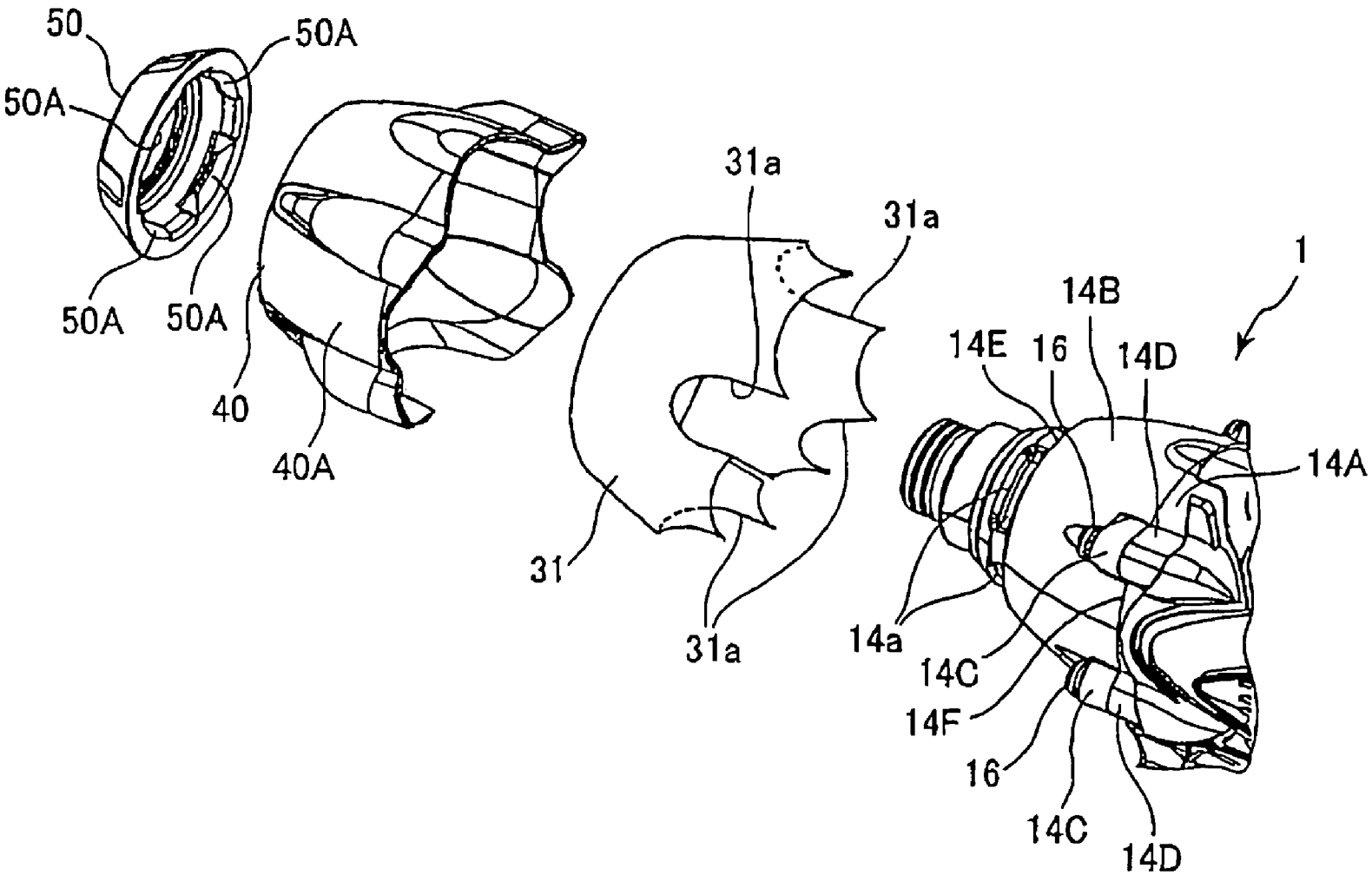
FIG. 3 is an exploded perspective view showing a combination of a portable tool, a cover and a label according to the first embodiment.

The outer frame 22 of the battery pack 20 is made of nylon resin. The outer frame 14 of the main body 10 includes a resin section 14A made of nylon resin and a hammer case 14B produced by die-casting with aluminum alloy to attain mechanical strength. The motive power section 11 and he mechanical section 12 are covered by the resin section 14A. The front-end tool section 13 positioned close to the front end of the portable tool 1 is covered by the hammer case 14B. The resin section 14A and the hammer case 14B have respective pairs of screw seats 14C, 14D that protrude outwardly from the outer frame 14 (FIG. 3). The resin section 14A and the hammer case 14B are secured to each other upon fastening four pan head screws 16 each formed with a cruciform groove at its head into the screw seats 14C, 14D. In FIG. 3, only two pan head screws are shown. The hammer case 14B corresponds to an aluminum alloy section.

Figure 4:
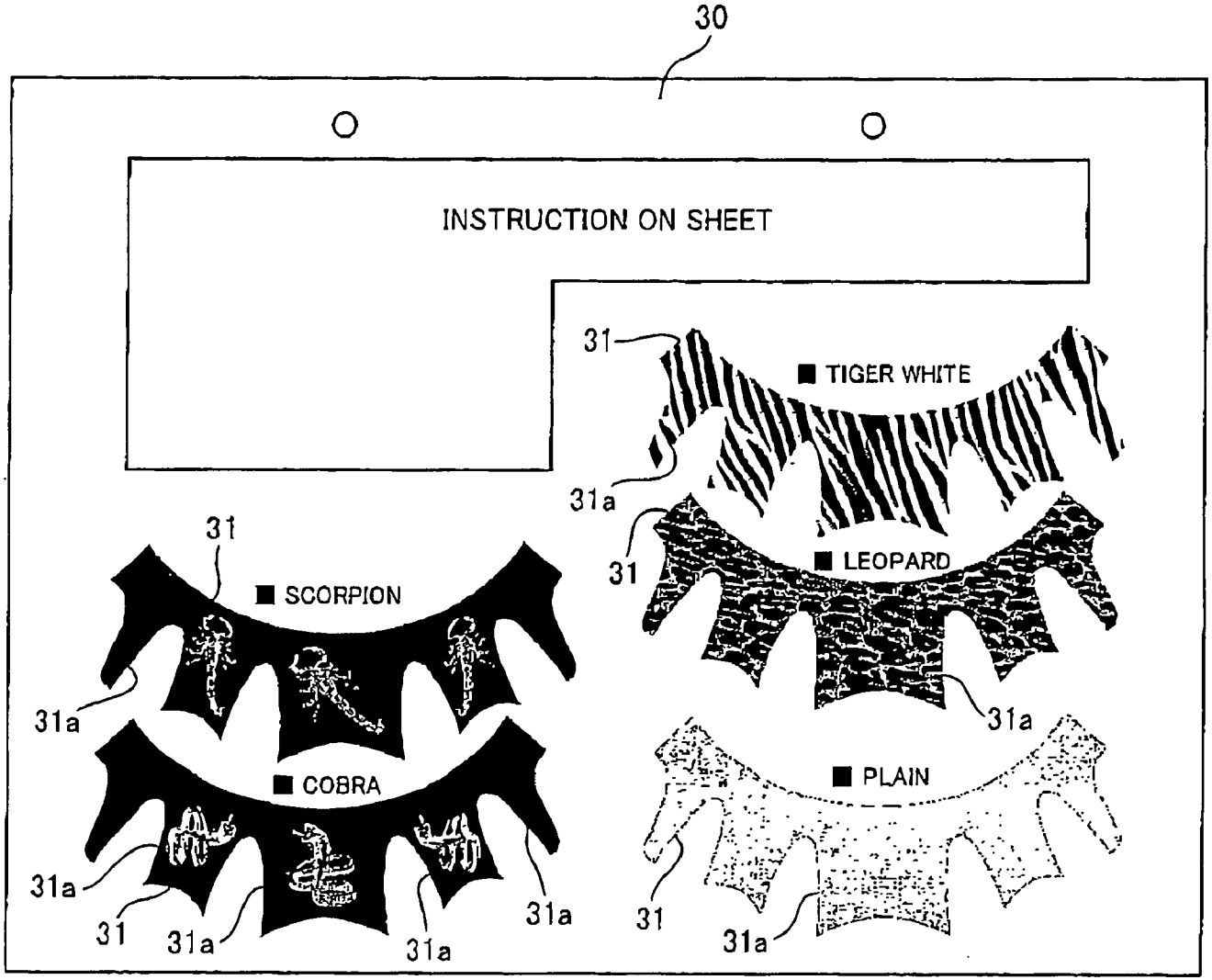
FIG. 4 is a schematic plan view showing a printed large sheet according to the first embodiment in which a plurality of labels or stickers for portable tools are printed.

The hammer case 14B has a tapered outer profile in such a manner that its diameter is gradually reduced toward its tip end. A label sheet 31 for the portable tool is bonded to an outer surface of the hammer case 14B. The label sheet 31 is made of paper and is formed with four arcuate recesses 31*a* having a predetermined width as shown in FIG. 4. A large sheet 30 is an accompaniment of the portable tool 1, and a plurality of such labels 31 are printed in the large sheet 30. The label sheet 31 is perforated along its contour. In other words, the label sheet 31 is ready for use when it is taken out of the large sheet 30 along the perforated line. Remaining area of the large sheet 30 other than the areas of the labels 31 is utilized as an explanatory area in which a method of using the labels 31 is described. An image of an animal or other pattern is printed on the surface of each label sheet 31 as shown in FIG. 4 so that a user can select one of the labels 31 dependent on his or her preference.

The label sheet 31 has a thickness of about 0.05 mm and the rear surface opposite to the front surface where the pattern is printed is made adhesive. Thus, the label sheet 31 functions as a sticker. While each label sheet 31 is two-dimensionally extends on the large sheet 30 for the purpose of printing, each label sheet 31 is cut out and the longitudinal opposite ends of the label sheet 31 are brought close to each other to make into annular shape with the front surface facing outside for use as shown in FIG. 3. Then, the entire rear surface is bonded to the hammer case 14B. Since the label sheet 31 is formed with recesses 31*a*, the label sheet 31 does not overlap with the screw seats 14C, 14D, and can be snugly fitted to the hammer case 14B as the label sheet 31 is wound around and bonded to the hammer case 14B.

The label sheet 31 that carries a specific image or pattern is selected according to the preference of a user and is affixed to the hammer case 14B of the portable tool 1 so that the user can identify the portable tool 1 by the label sheet 31. Therefore, it is no longer necessary for the supplier to paint the outer frames 14 of portable tools of the same sort in different colors during the manufacturing process and each portable tool 1 can be colored with the labels according to the preference of the user. This provides greater advantage particularly in terms of production cost and distribution of the tools. While the user selects a specific label sheet 31 for the portable tool with his or her preference, the label sheet 31 can be replaced by another label that carries a different pattern whenever the user becomes tired of the image or pattern.

Further, the label sheet 31 for the portable tool having a contour that matches the profile of the hammer case 14B is printed on the large sheet 30 and is perforated along the contour of the label sheet 31. Therefore, the user only needs to remove the label sheet 31 out from the large sheet 30 and bond the label sheet 31 to the hammer case 14B. It is a very simple operation that can be completed without fail. Furthermore, since the rear surface of the label sheet 31 is made adhesive, there is no risk for the label sheet 31 to be displaced unintentionally when a cover or a protector 40 for the portable tool 1 is disposed over the hammer case 14B. Since the large sheet 30 contains a plurality of labels 31, the user can select any one of the labels with his or her preference, seeing the patterns and the colors of the labels 31.

The cover 40 for the portable tool (FIG. 2) is put on the outer surface of the hammer case 145 at a position where the label sheet 31 is affixed. The cover 40 has a hollow cylindrical profile that matches the profile of the hammer case 14B. The cover 40 substantially entirely covers the hammer case 14B from its front end facet 14E to its base section 14F where the hammer case 14B is connected to the resin section 14A. Thus, the cover 40 completely covers not only the screw seats 14C (FIG. 3) and the heads of the pan head screws 16 each fastened into the screw seat 14C of the hammer case 14B, but also the label sheet 31 affixed to the outer surface of the hammer case 14B.

The cover 40 that completely cover the hammer case 14B including the screw seats 14C is referred to as a fitting section 40A. Substantially no gap is defined between the front surface of the label sheet 31 where a pattern is printed and the inner peripheral surface of the cover 40. In other words, the inner peripheral surface of the cover 40 is in direct contact with the label sheet 31. Further, a part of the inner peripheral surface of the cover 40 contacts a part of the hammer case 14B. The cover 40 has a thickness of about 1 mm The cover 40 made from a transparent resin such as PP (polypropylene) or some other high hardness resin to provide a given rigidity. Therefore, unlike a soft flexible rubber, partial turning over or folding of the cover 40 is avoidable. In other words, the cover 40 can maintain its original profile.

A rubber-made front cap 50 is disposed at the front end facet 14E of the hammer case 14B. The front cap 50 has an annular configuration and can be removably fitted to the hammer case 14B. Four projections 50A (FIG. 3) protrude radially inwardly from an inner peripheral surface of the front cap 50. These four projections 50A are arranged at an regular interval in the circumferential direction of the front cap 50. Since the front cap 50 can be removably fitted to the hammer case 14B, the cover 40 can be easily fitted to and removed from the portable tool 1. Additionally, the label sheet 31 can be easily affixed to the hammer case 14B and can be replaced with a new label sheet 31.

On the other hand, four recesses 14*a* are formed at the end facet 14E of the hammer case 14B and dimpled radially inwardly of the latter. The recesses 14*a* have a profile that matches the profile of the projections 50A. These four recesses 14*a* are arranged at a regular interval in the peripheral direction of the hammer case 14B and are engageable with the corresponding projections 50A. The projections 50A and the recesses 14*a* are respectively held in engagement with each other so that the front cap 50 is not movable relative to the hammer case 14B and the cover 40. The projections 50A and the recesses 14*a* function as engaging sections that are engaged with each other. After the cover 40 is fitted to the hammer case 14B, the front cap 50 is fitted to the hammer case 14B coaxially in such a manner that the front cap 50 is in contact with the cover 40 at the end facet 14E.

Since the front cap 50 is made of rubber, the front cap 50 does not come off from the hammer case 14B during operation because of the elastic deformation of the projections 50A when the latter are held in tight engagement with the corresponding recesses 14*a*. When the front cap 50 is fitted to the hammer case 14B, the cover 40 is pinched between the front cap 50 and the hammer case 14B. The front cap 50 is no longer movable relative to the hammer case 14B. Accordingly, the cover 40 is also made immovable relative to the hammer case 14B. Thus, the cover 40 can be made from a rigid material.

If the front cap 50 were not provided, the cover 40 would have to be made of a soft and flexible material such as rubber because resilient projections have to be formed along the inner peripheral surface of the cover 40 for engagement with the recesses 14*a*. In the latter case, the flexible cover may be flipped or folded during operation and may be stained. However, such a problem does not occur if the elastic front cap 50 is provided separately from the rigid cover 40. Incidentally, rotation of the cover 40 over the hammer case 14B can be prevented because the cover 40 has an irregular cross-sectional shape for covering the screw seats 14C and the heads of the pan head screws 16.

To put the label sheet 31 on the portable tool 1 or to replace the label sheet 31 by a new label sheet, firstly the projections 50A of the front cap 50 are disengaged respectively from the corresponding recesses 14*a* by means of a minus tip screw driver for releasing the front cap 50 from the hammer case 14B. Then, the cover 40 is removed from the hammer case 14B to expose the latter. If the label sheet 31 is already affixed to the hammer case 14B, the label sheet 31 becomes exposed to the atmosphere. Thereafter, the label sheet 31 is peeled off and removed from the hammer case 14B.

Then, one preferred label sheet 31 is selected from the large sheet 30 containing a plurality of labels 31 as shown in FIG. 4. Alternatively, a blank label sheet 31 is selected and a user writes down his or her own name and address. Thereafter, the selected label sheet 31 is affixed to the hammer case 14B.

Then, the cover 40 is fitted to the hammer case 145 and the projections 50A of the front cap 50 are respectively brought into engagement with the corresponding recesses 14*a* of the hammer case 14B so as to immovably secure the front cap 50 to the hammer case 14B. Thus, the operation of fitting the label sheet 31 to the hammer case 14B is completed.

Since the label sheet 31 is fitted to the hammer case 14B and is covered by the transparent cover 40, a user can easily and reliably identify his or her own portable tool 1, seeing the label sheet 31 through the cover 40. Further, when the portable tool 1 is used near a white wall and the screw seats 14C of the hammer case 14B projecting outward toward the white wall are rubbed against the white wall, the label sheet 31 is not brought into direct contact with the wall because the hammer case 14B including the screw seats 14C is entirely covered by the transparent cover 40. Thus, the printed colors on the label sheet 31 are prevented from being transferred onto the wall. If the cover 40 is stained by dirt, the dirt can be easily removed from the cover 40 so that the portable tool 1 can maintain its aesthetic appearance.

The manufacturer now can satisfy the individual preference of buyers/users of portable tools not by differentiating the colors of the outer frames of tools during manufacturing process but by differentiating images and/or patterns of the label sheets 31. This can provide great advantage in terms of production cost and distribution. Additionally, the user selects one label sheet 31 among various label sheets 31 based on his or her preference, seeing the design thereof, and can easily replace the label sheet 31 by a new label sheet whenever he or she becomes tired of the old label sheet.

Further, since the label sheet 31 is covered by the cover 40, colors or a pattern printed on the label sheet 31 can hardly come off and the pattern can hardly become damaged. Therefore, prolonged service life of the label sheet 31 can result.

Further, the hammer case 14B is tapered in such a manner that its diameter is gradually reduced toward its tip, and the label is fitted to the outer periphery of the tapered section of the hammer case 14B, while the cover 40 also has a tapered profile corresponding to that of the hammer case 14B and is fitted to the hammer case 14B as the inner peripheral surface of the cover 40 is brought to contact with the label sheet 31 and the tapered part of the hammer case 14B. Therefore, if the rear surface of the label sheet 31 is not made adhesive, a possibility of a direct contact of the label sheet 31 with the inner peripheral surface of the cover 40 can be minimized or reduced during movement of the cover 40 for assembly over the hammer case 14B after disposing the label sheet 31 over the hammer case 14B. Thus, displacement or deviation of the label sheet 31 disposed over the hammer case 14B during the assembly of the cover 40 can be prevented.

Figure 5:
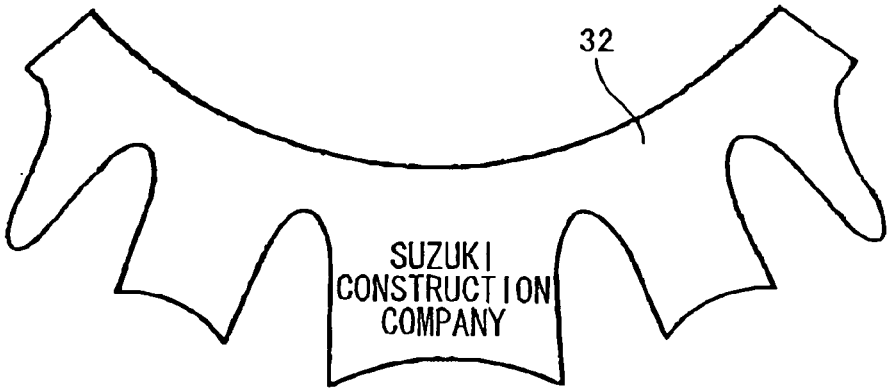
FIG. 5 is a plan view showing a label according to a first modification.
Figure 6:
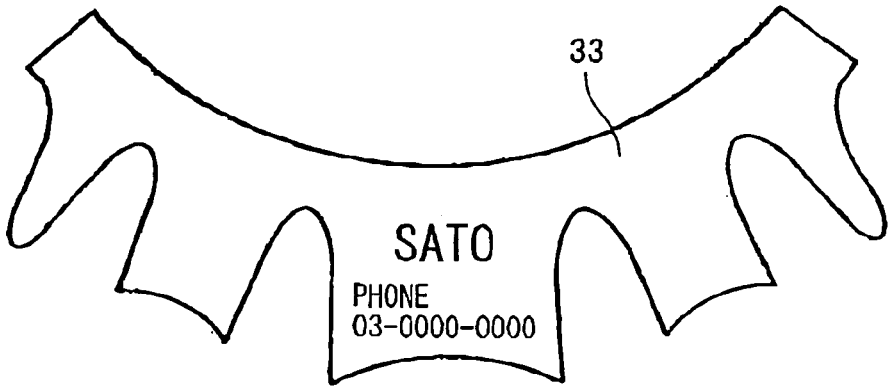
FIG. 6 is a plan view showing a label according to a second modification.
Figure 7:
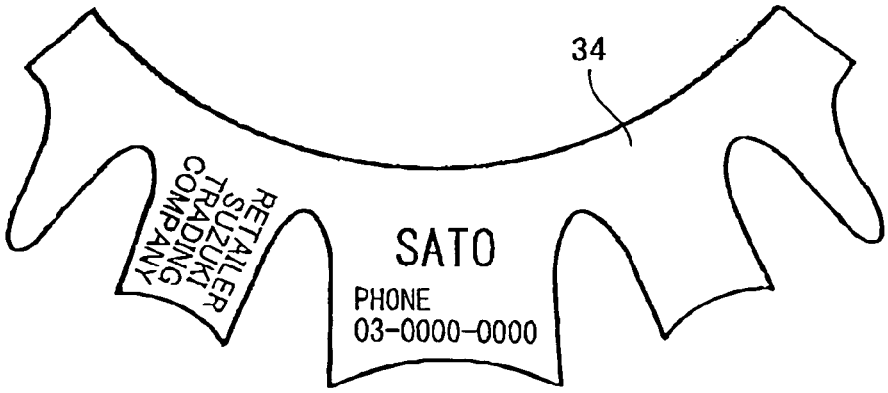
FIG. 7 is a plan view showing a label according to a third modification.

FIG. 5 shows a first modified label 31 in which the name of the user company can be printed. Alternatively, as shown in FIG. 6 illustrating a second modified label 33, the name and the telephone number of the user who owns the portable tool 1 can be printed on the label 33. Still alternatively, as shown in FIG. 7 illustrating a third modified label 34, not only the name and the telephone number of the user but also a supplier of the portable tool can be printed on the label 34 by means of a printer and a personal computer as sales promotion service. Still alternatively, the user can print his original design or color on the label 31.

A label sheet for a portable tool according to a second embodiment of the present invention will be described with reference to FIGS. 8 through 11. The second embodiment also pertains to a method for providing a label sheet.

In the above-described first embodiment, a user can select one of the labels 31 carrying a pattern or color that satisfy his or her preference among various labels in the large sheet 30 for identification of the portable tool 1. However, if the number of labels 31 or the number of large sheets 30 is increased, resultant cost for making the large sheet 30 is inevitably increased, and further, a number of labels 31 may be left unused and wasted. Therefore, the second embodiment overcome the deficiencies, and provides a method of printing a label and a method of providing such a label that allow the user to select a specific label out of a large number of candidate labels 31 without raising the cost.

Figure 8:
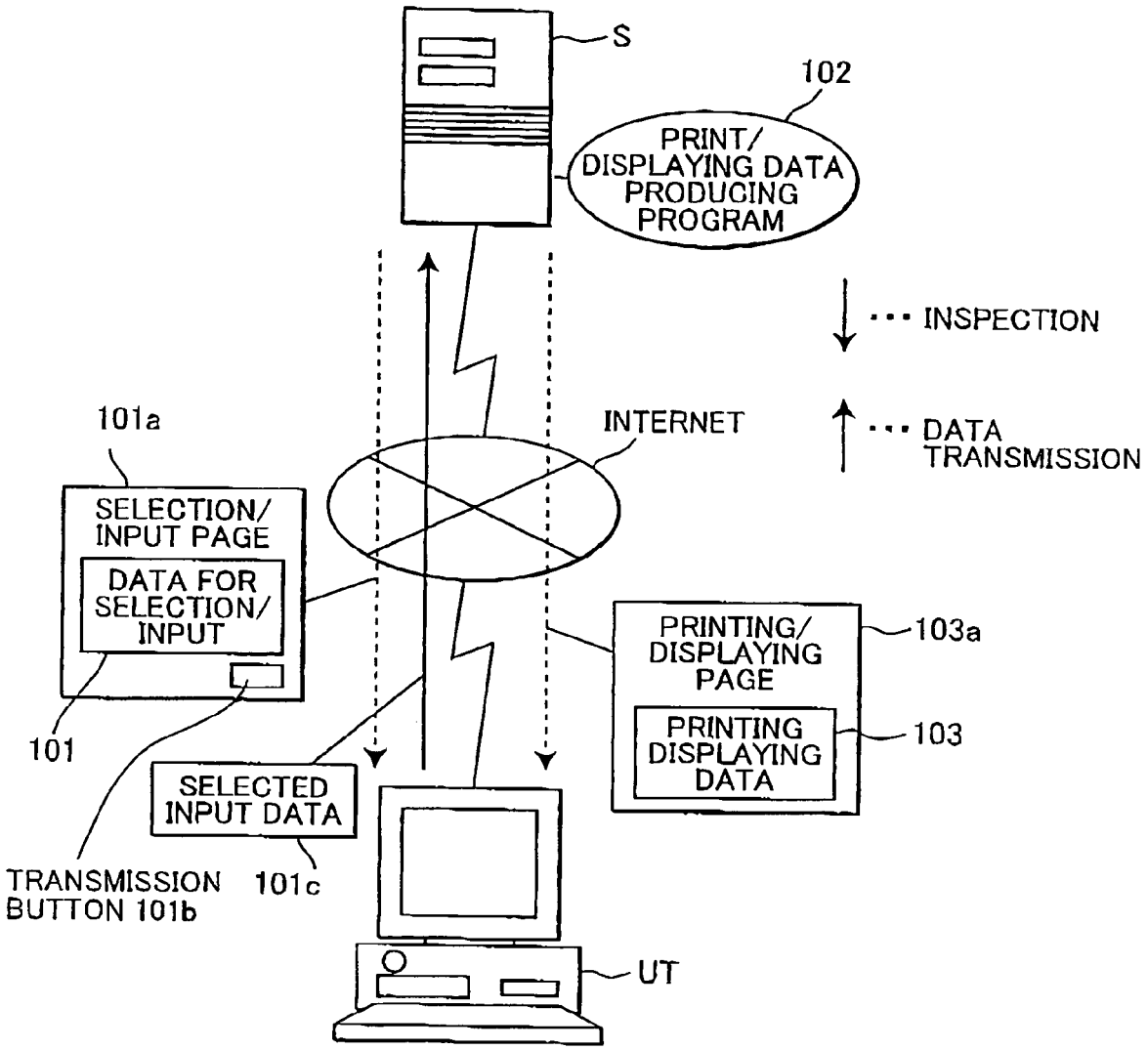
FIG. 8 is a schematic illustration showing the relationship between a user terminal and a server for description of label supplying method according to a second embodiment of the present invention.

As shown in FIG. 8, the method of printing a label for a portable tool is executed in an environment where an Internet server S and a user terminal UT are connected to each other by way of the Internet.

Figure 10:
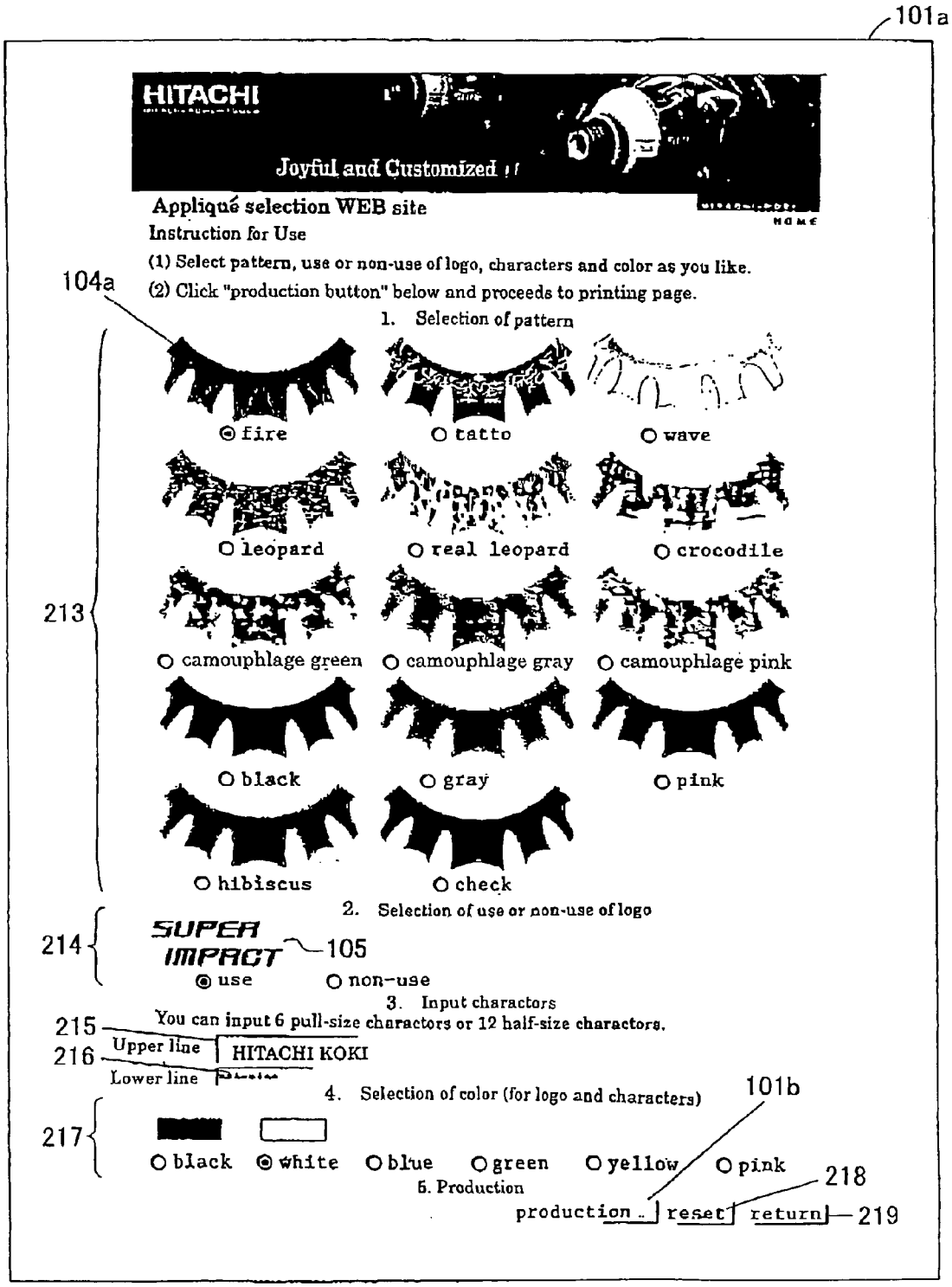
FIG. 10 is a plan view showing a page on a display screen according to the second embodiment for prompting a user to select a logo, characters and a pattern.

The server S stores images data of a number of labels each providing an external contour. On the other hand, the user terminal UT stores data 101 for selection/input that can be displayed on the display screen of the user terminal UT as selection/input page 101*a* and in which the user can display and view the images 104*a* of the stored image data and can select one of the images 104*a* (FIGS. 8, 10). The selection/input page data 101*a* also contains a transmission button 101*b* for transmitting data that the user selects.

As shown in FIG. 10, the selection/input page 101*a* includes an image selection part 213 in which a plurality of down-sized images 104*a* of the image data 104 that the server stores are displayed, so that the user can select one of the displayed images 104*a*. The selection/input page 101*a* also includes a logo selection part 214, first and second character input parts 215, 216, and a color selection part 217. The logo selection part 214 is used for selecting or non-selecting the logos 105 to be put on the label sheet 31. In the first and second character input parts 215, 216 the user can input characters to be described on the label sheet 31. The color selection part 217 is adapted for selecting each color of the logo 105 and the characters. Thus, the user can select and input what he or she likes for the logo, characters and colors by using selection/input parts provided in the logo selection part 214, the first and second character input parts 215,216 and the color selection part 217.

The selection/input page 101*a* also contains the transmission button 101*b*, a reset button 218 and a return button 219. After selecting and inputting data through the selection/input parts 213 through 217, the user clicks transmission button 101*b* whereupon the selected and input data are transmitted from the user terminal UT to the server S by way of the Internet as data 101*c* (FIG. 8) This data transmission can be made when an information transmission program stored in the data 101 for selection/input is executed as a result of clicking the transmission button 101*b*. Thus, the selected and input data can be transmitted to the server S as the data 101*c*.

The reset button 218 is adapted for resetting data selected in the selection/input parts 213 through 217. In other words, the data 101 for selection/input includes data resetting means that erases the data selected and input by the user when the reset button 218 displayed on the selection/input page 101*a* is clicked by the user. Therefore, the user can easily replace the data with new data.

Upon receiving the selected and input data 101*c*, a printing/displaying data producing program 102 of the server produces printing/displaying data 103 according to the data selected and input by the user and displays the printing/displaying data 103 in a printing/displaying page 103*a* on the display screen of the user terminal UT. Thus, shortly after clicking the transmission button 101*b* in the selection/input page 101*a*, the user can inspect an image of his unique label for his or her portable tool based on the selected and input data 101*c* on the display screen of the user terminal UT. If the user is satisfied with the label displayed on the display screen, the user downloads the data of the label and prints the label image. Then, the user cuts the label along its outer contour and then bonds the cut label to the portable tool, for example, between the hammer case 14B and the cover 40 (FIG. 3).

It is advantageous to use a commercially available label that is adhesive at the rear surface and hence adapted to be used as sticker for printing an image of the printing/displaying page 103*a* because the label after cutting can be easily bonded to the portable tool.

The printing/displaying page 103*a* will be described in detail with reference to FIG. 11. The printing/displaying page 103*a* shows two images 104*b*, 104*c* having a profile identical with that of a label for the portable tool. The two images 104*b*, 104*c* carry two different sets of characters 215*a*, 215*b* and 216*a*, 216*b* shown respectively on the front faces and in the insides the boundaries of these images 104*b*, 104*c*.

The images 104*b*, 104*c* that are displayed on the printing/displaying page 103*a* are the same as the image 104*a* shown with reduced dimensions and selected by the user on the selection part 213 of the selection/input page 101*a*. These images have profiles adapted to cover a part of the outer frame of a portable tool and to be inserted between the portable tool and the cover for the portable tool.

The characters shown in the images 104*b*, 104*c* include the characters 215*a*, 215*b* selected by the character input part 215 and the characters 216*a*, 216*b* selected by the character input part 216 of the selection/input page 101*a* In view of the restriction that characters cannot be displayed aslant on the display screen of the user terminal UT in the selection/input page 101*a*, two images 104*b*, 104*c* having a profile the same as that of the label selected in the selection/input page 101*a* are shown. As shown in FIG. 11, one image 104*b* is oriented transversally, and a line of characters is directed perpendicular to an axial direction of the front end tool when the label is affixed thereto. On the other hand, the other image 104*c* is oriented aslant on the display screen, and a line of characters is directed in parallel to the axial direction of the front end tool when the label is affixed thereto.

While the data of image 104*a* are stored in the server S, the printing/displaying data 103 are so constructed in such a way that both the transverse image 104*b* and the slanting image 104*c* can be displayed on the display screen of the user terminal UT, the transverse image 104*b* and the slanting image 104*c* being identical with the reduced sized image 104*a* selected on the selection/input page 101*a* in terms of design and pattern.

Figure 11:
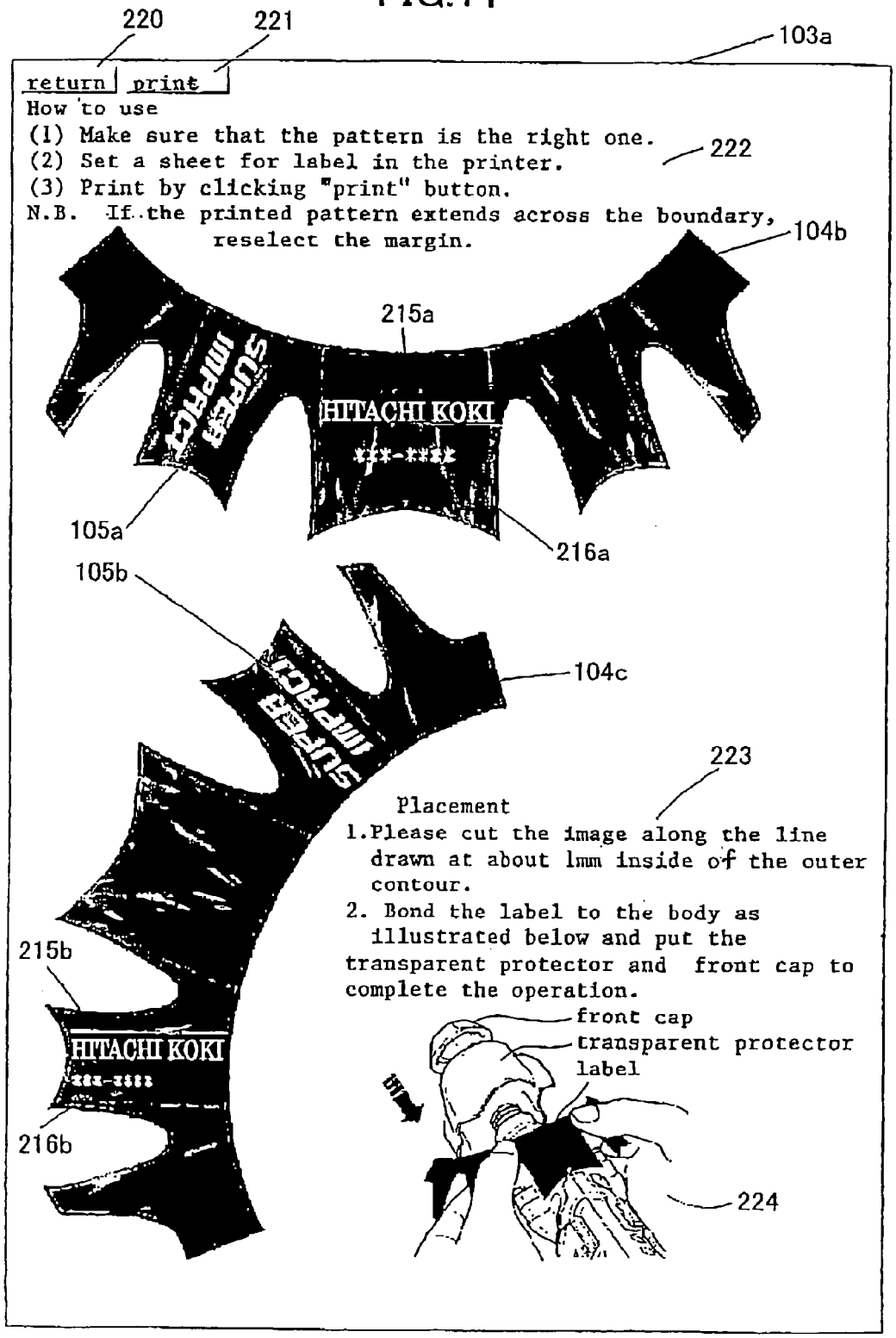
FIG. 11 is a plan view showing a page on a display screen according to the second embodiment for prompting a user to confirm the designed image and print the image.

As shown in FIG. 11, the characters 215*a*, 215*b* are made larger than the characters 216*a*, 216*b*. The character 215*a*, 215*b* may be those of the name of the user or that of the company to which the tool belongs, which needs to be eye-catching, whereas the characters 216*a*, 216*b* may be those of the telephone number.

The printing/displaying data preparation program 102 is operated to produce the printing/displaying data 103 so as to make the color of the characters displayed on the printing/displaying page 103*a* the same as the color selected by the color selection part 217 of the selection/input page 101*a* in the user terminal UT.

Further, as shown in FIG. 11, logo images 105*a*, 105*b* are displayed at respective positions located inside the boundaries of the respective images 104*a*, 104*b* of the printing/displaying page 103*a*, if the user selected the use of the logo with the logo image selection part 214 of the selection/input page 101*a*. The server stores data on the logo images 105*a*, 105*b* whose numbers correspond to the numbers of colors the user can select with the color selection part 217 of the selection/input page 101*a*. Thus, the printing/displaying data producing program 102 produces printing/displaying data 103 in such a way that the logo images 105*a*, 105*b* can be displayed on the printing/displaying page 103*a* with the color selected by the user in the selection/input page 101*a*.

The printing/displaying data 103 include a program for fixing the display format so that the sizes of the characters and the images displayed in the printing/displaying page 103*a* on the display screen of the user terminal UT are not altered With this arrangement, the profile and the size of the printed label for the portable tool are made to reliably match the portable tool and any of the characters does not come out of the boundary of the printed label.

Incidentally, the data 101 for selection/input include character number limiting program for limiting the number of characters input through the character input parts 215, 216 of the selection/input page 101*a*. With this arrangement, the profile of the label displayed on the printing/displaying page 103*a* and the characters shown on the label always show an appropriate relationship.

As shown in FIG. 11, the printing/displaying page 103*a* also bears a return button 220, a print button 221, a first instruction part 222, a second instruction part 223 and an illustration part 224. The print button 221 is adapted to print the printing/displaying page 103*a* based on the displayed images 104*b* and 104*c*. The first instruction part 222 describes printing procedure. The second instruction part 223 and the illustration part 224 show a method of putting the label onto the portable tool. Therefore, the user can print the printing/displaying page 103*a*, cut out the label for the portable tool and bond the label to the portable tool by following the instruction parts 222,223 and illustration part 224.

Figure 9:
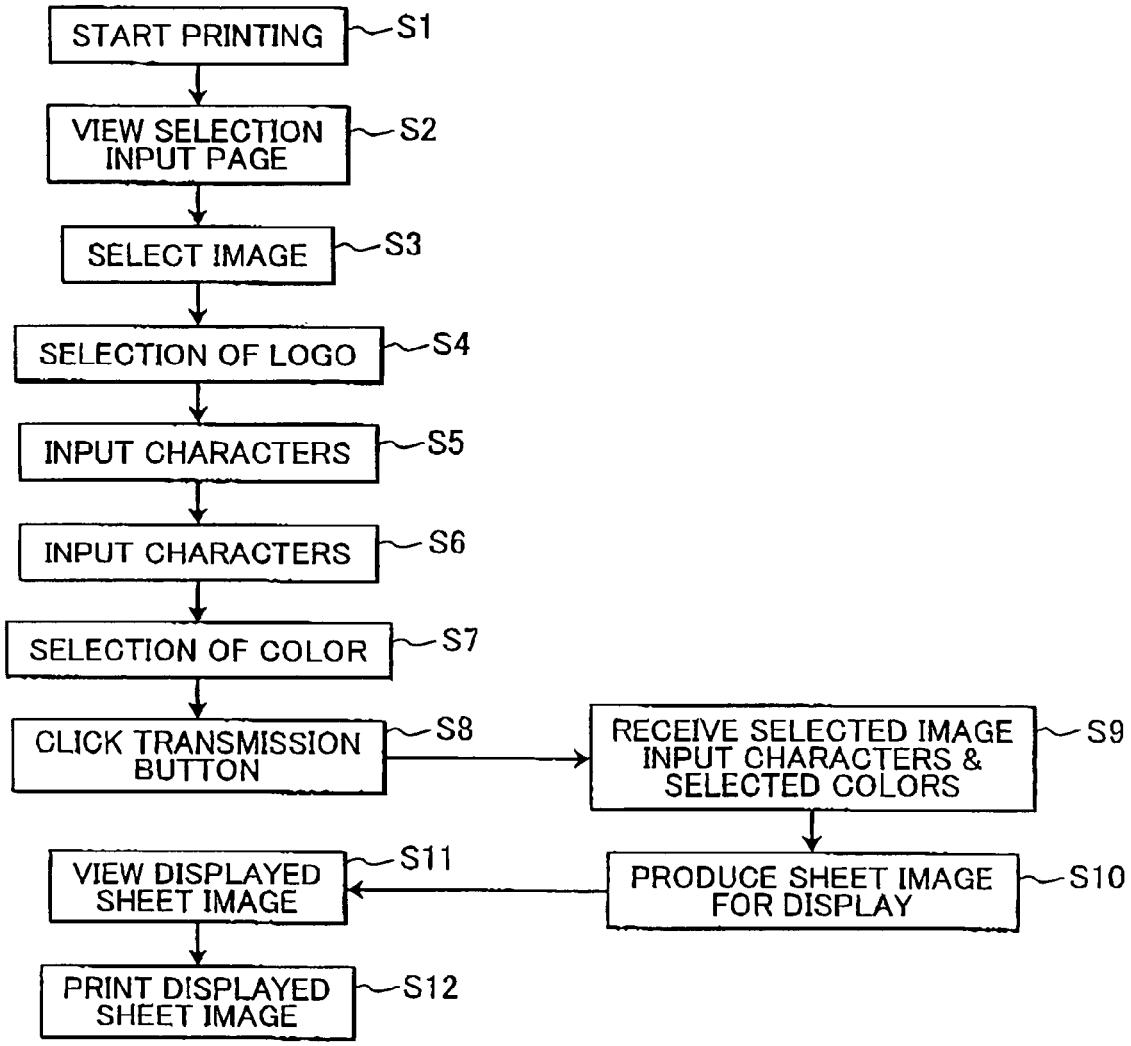
FIG. 9 is a flow chart showing printing process according to the second embodiment.

Will be described with reference to a flowchart shown in FIG. 9 the overall process for printing a desired label If the user accesses to an Internet web cite associated with the server S (S1), the user can inspect the selection/input page 101*a* (S2) As the user selects one of the images 104*a* in the image selection part 213 of the selection/input page 101*a*, the data on the selected image is added to the selection/input data 101*c* (S3). For example, if a fire pattern is selected, data "fire_pattern" is retrieved in the selection/input data 101*c*. If a tattoo pattern is selected, data "tattoo_pattern" is retrieved in the selection/input data 10*c*.

Then, if the use of the logo is selected with the logo image selection part 214, "1" which is indicative of selection of the use of the logo is added to the selection/input data 101*c* (S4). Then, the data of characters input with the character input parts 215, 216 are added to the selection/input data 101*c* (S5, S6). Thereafter, the data of color selected with the color selection part 217 is added to the selection/input data 101*c* (S7). For example, "0" is added to the selection/input data 101*c* if the selected color is black, whereas "1" is added to the selection/input part 101*c* if the selected color is white.

The data selected and input by the user are transmitted to the server S, when the transmission button 101*b* is clicked by the user to execute the data transmission program (S8), and the server S receives data of selected image 104*a*, selection of logo, selected color and input characters (S9). Then, the program 102 stored in the server S for displaying the desired label image produces the printing/displaying page 103*a* based on the selected image 104*a*, selection of logo, selected color and input characters (S10). Then, the printing/displaying page 103*a* is inspected through the display of the user terminal UT (S11). For example, if the data "fire_pattern" is added to the selection/input data 10*c*, the printing/displaying data production program 102 produces the images 104*b*, 104*c* with the fire pattern to be displayed on the display screen of the user terminal UT. Similarly, if the data "1" is added to the selection/input data 101*c* to indicate that the use of the logo is selected by the user with the logo image selection part 214, the printing/displaying data production program 102 adds the logo images 105*a*, 105*b* with the color selected with the color selection part 217 and displays these label images 104*b*, 104*c* and the logo images 105*a* 105*b* superimposed thereon. Furthermore, the printing/displaying data production program 102 also causes the sets of characters input through the character input parts 215, 216 to be displayed respectively in the insides of the boundaries of the images 104*b*, 104*c* so as to be imposed on the latter with the color selected with the color selection part 217. If the user is satisfied with the resultant images displayed on the display screen, the user clicks the print button 221 (S12).

Figure 12:
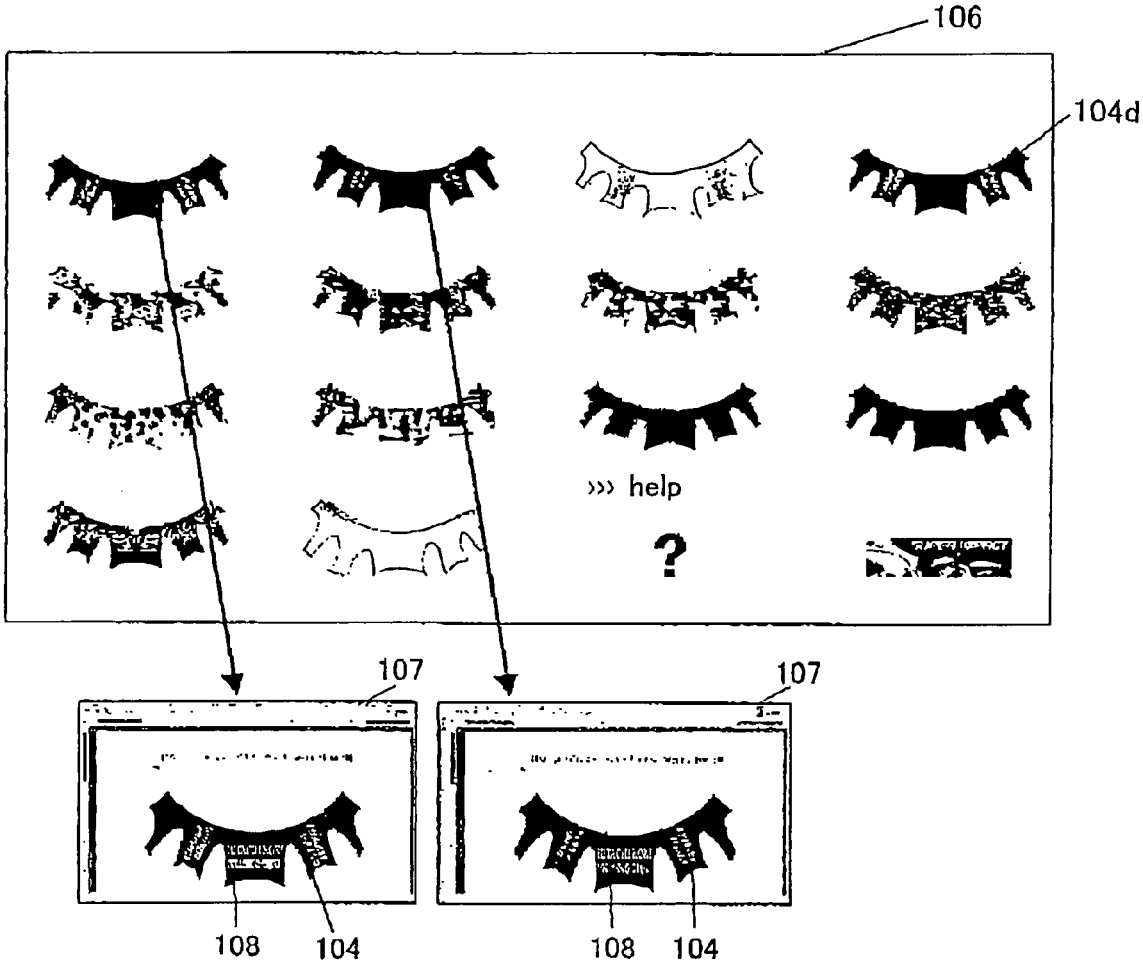
FIG. 12 is a plan view showing a page on a display screen according to a third embodiment of the present invention for prompting a user to select a pattern and showing the current status of editing the data file.

A label for a portable tool according to a third embodiment of the present invention will be described with reference to FIG. 12. In the second embodiment, an image of the originally designed label is automatically displayed upon operation of the selection/input page 101*a*. In the third embodiment, the user can directly add characters or another image on a displayed label image which has been selected in an image selection page 106. That is, the user terminal stores therein an editing software, and a server also stores data to be used for editing. The user can directly add characters and/or images stored in the server with using the editing software into the selected label image.

More specifically, as the user selects one of down-sized images 104*d* to be used in the image selection page 106 showing a plurality of down-sized images 104*d* of different candidate patterns. A data file 107 containing data on the selected image becomes available to the user on the display screen of the user terminal. The image 104*d* of the label in the data file 107 already carries characters 108 in the inside of the image 104*d* that are superimposed on the image 104*d*. However, the user can replace the characters 108 with other desired image the user selects and also superimpose the desired image on the image 104*d* in the inside of the image 104*d* by means of the editing software. In this sense, this embodiment is more sophisticated than the second embodiment.

As described above, in the method of printing a label and a method of supplying such a label according to the second and third embodiments of the invention, the user can inspect a number of candidate labels carrying different patterns thereon by way of the Internet at low cost so as to select one label to be fitted to his portable tool in order for the user to be able to identify his own portable tool. Then, the user can select and print one of the candidate labels, superimposing appropriate characters on the label without damaging the aesthetic value of the label. Thus, the user can be supplied with a label carrying a unique pattern that satisfies his preference.

Additionally, the user can buy a marketed cover for a portable tool that is made of a transparent material and puts a label for the portable tool between part of the outer frame of the portable tool and the cover. Thus, the user can add a label having a unique pattern and characters that satisfy the preference of the user, and the label hardly comes off from the portable tool.

Further, the label image supplier can easily supplies data through Internet to the users and shops selling the tool at anywhere and anytime, and an original label indicative of the own user can be easily produced through the Internet at anywhere and anytime by the users and the shops.

Additionally, the printed characters such as name, address and telephone number those printed on the label do not disfigure the resultant label image in comparison with the handwritten characters. Therefore, the user can reliably identify his own tool. In other words, if the information is written in characters on the label by means of a pen, the label may be simply wasted when the user cannot write down the information neatly, correctly and properly on the label because the written characters are too large to contain all the necessary information there, or when the characters are written at irregular intervals, or one or more misspelling are involved. Further, incomplete information is written due to lack of care. Furthermore, if names and address etc. are printed separately by a printer and apply the printed labels to their respective tools, then, the profile of the label prepared by the user may not conform to the size of the separately printed name etc. and the name etc. may eventually protrude out of the outer contour of the label. These conceivable drawbacks do not occur in the second and third embodiments.

Further, the second and third embodiments can provide advantages for managing a number of tools of the same sort by adding numbers and the company name on a number of labels and putting the labels on the tools.

While the invention has been described in detail and with reference to specific embodiments thereof, it would be apparent to those skilled in the art that various changes and modifications may be made therein without departing from the scope of the invention In other words, the cover, a combination of the portable tool and the cover and a combination of the portable tool, the cover and the label according to the invention are not limited to the above-described embodiments.

Figure 13:
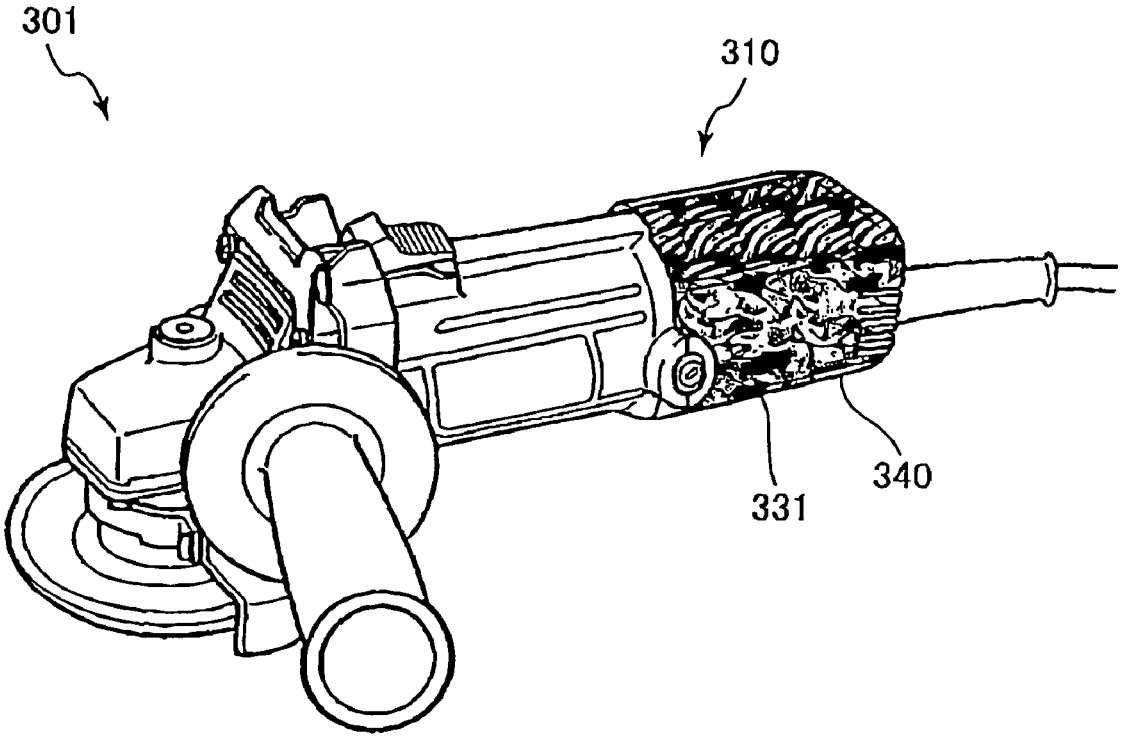
FIG. 13 is a perspective view showing a portable tool on which a label and a cover are put as a modification to the first embodiment.

For example, while the portable tool 1 of each of the above-described embodiments is a cordless impact driver, it may be some other portable tool such as a disk grinder and a pneumatic nail gun. As shown in FIG. 13, a label 331 that carries a pattern thereon may be stuck to an end portion of a handle 310 of a disk grinder 301 and the end portion of the handle 310 and the label 331 can be covered by a transparent cover 340. With this arrangement, if the handle 310 is made of an aluminum alloy, the cover 340 made of resin can be used. As a result, the grip gives a soft and not slippery feeling. Additionally, when the disk grinder 301 protected by the cover is put on a timber, the top surface of the timber is prevented from being damaged by the rigid handle 310.

Figure 14:
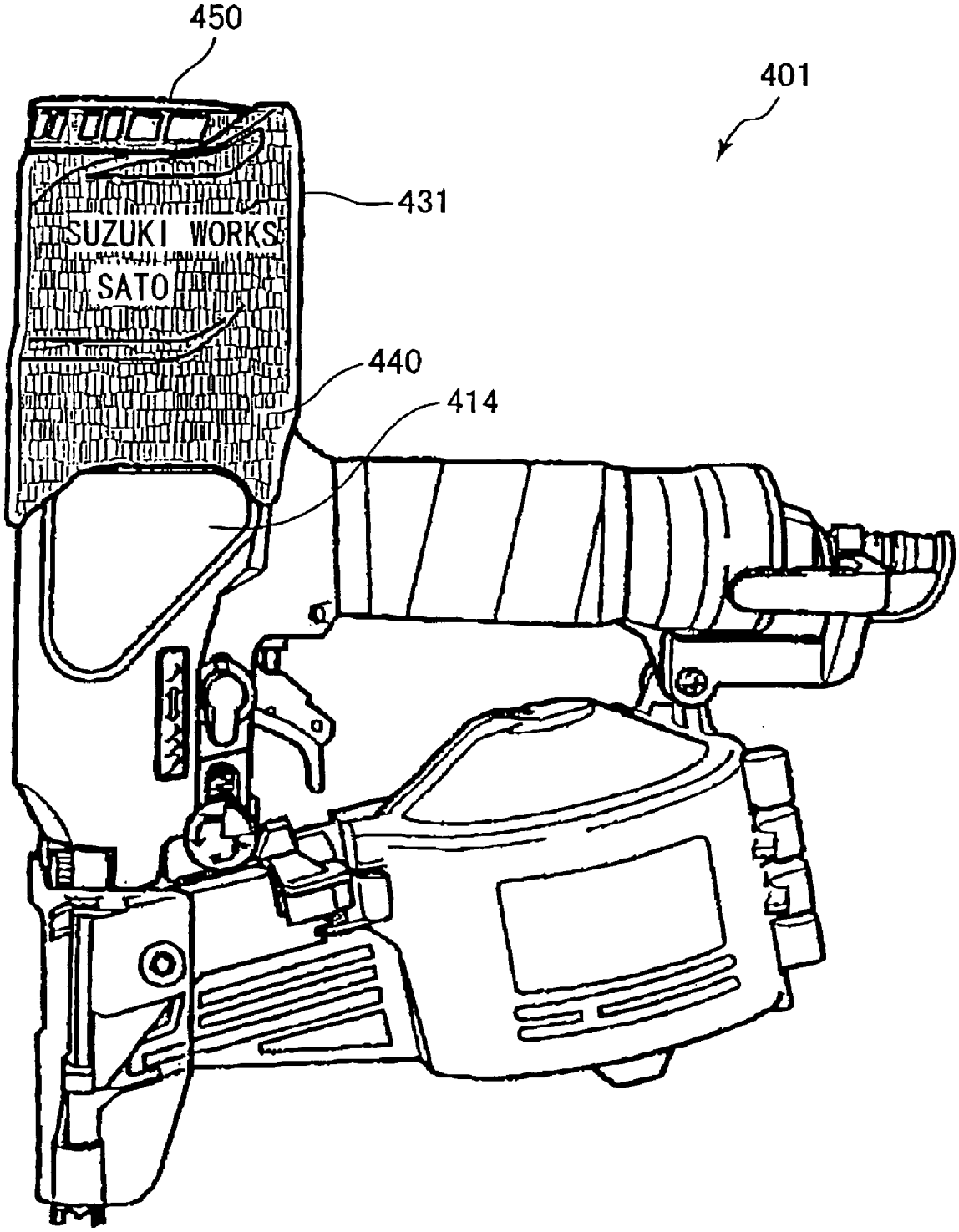
FIG. 14 is a plan view showing a portable tool to which a label and a cover are put as another modification to the first embodiment.

In the case of the pneumatic nail gun, as shown in FIG. 14, a label 431 that carriers a pattern and the name of the proprietor of the portable tool thereon is bonded to an outer frame 414 of the nail gun 401, and a transparent cover 440 is disposed over the label 431. In this case, an exhaust port member 450 is adapted to immovably support the cover 440 with respect to the outer frame 414 similar to the function of the front cap 50 of the first embodiment.

Figure 15:
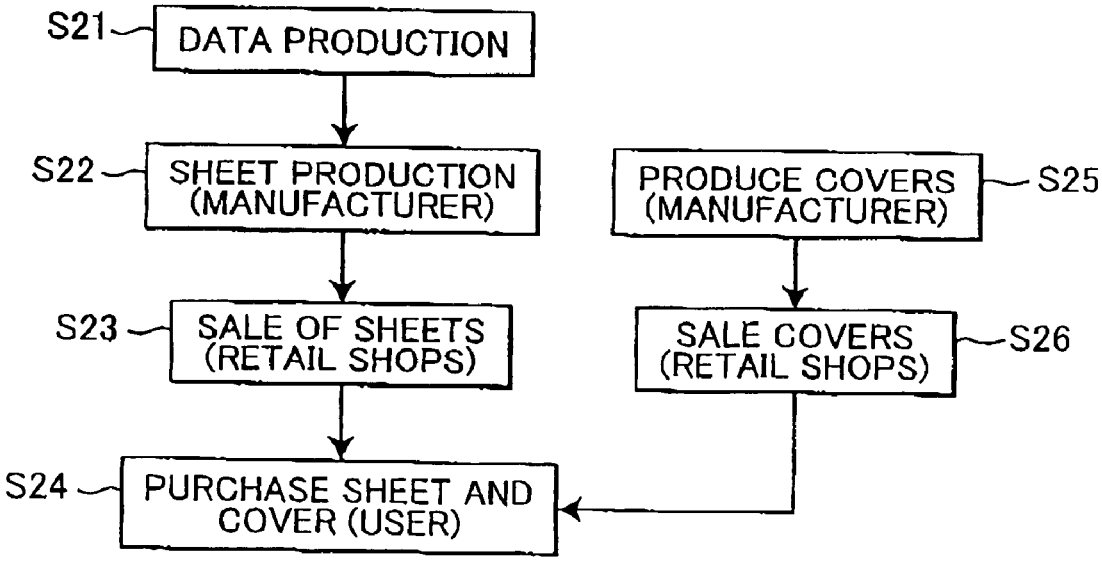
FIG. 15 is a flow chart showing a process for providing a label and a cover for a portable tool according to a first modification to the second embodiment.

Further, while the cover 40 and the large printed label 30 containing a number of labels 31 can be sold with a portable tool 1 as kit in the case of the first embodiment, the present invention is by no means limited thereto. For example, labels and covers can be marketed separately from portable tools, and further, the labels can be sold separately from the covers. More specifically, referring to FIG. 15, original label images are produced by a manufacturer of portable tools (S21) and the labels are produced by the manufacturers (S22). Then, retail shops sell the labels (S23). A user who bought the label bonds the label to the tool (S24). On the other hand, the manufacturer manufactures covers (S25) and retail shops sell the covers (S26). The user who bought the label also buys the cover for the portable tool and puts the cover on the tool to which the label is bonded (S24).

Further, the first embodiment can also be modified that the retail shop or the user can print a label on the basis of the data distributed to the retail shop or to the user, whichever appropriate. With this arrangement, it is no longer necessary for the manufacturer to package up a label with the tool. Therefore, the retail shop can prepare labels and provide users with such labels as a service activity. Alternatively, the user can easily prepare such a label at his house.

Figure 16:
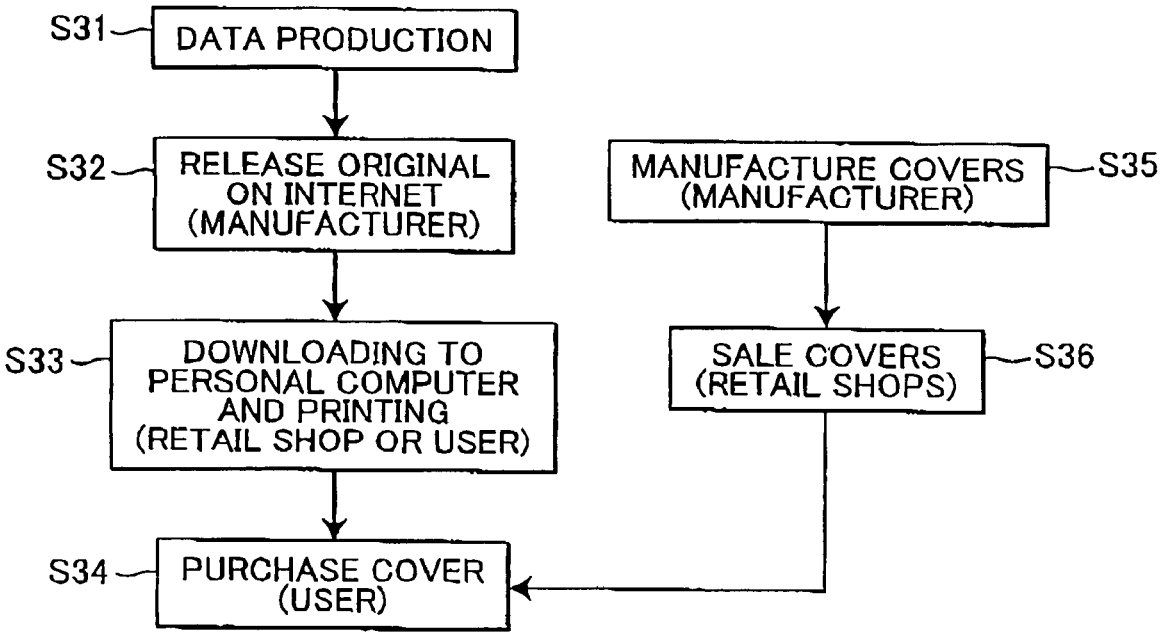
FIG. 16 is a flow chart showing a process for providing a label and a cover for a portable tool according to a second modification to the second embodiment.

The data necessary for preparing labels can be distributed by way of the Internet or by way of recording mediums such as CD-ROMs and/or flexible disks. For example, when the data necessary for preparing labels are distributed by way of the Internet, as shown in FIG. 16, firstly, original label image data are produced by the manufacturer of the tools (S31) and the data are stored in the server of the manufacturer so as to be accessible by way of the Internet (S32).

Then, the retail shop or the user downloads the data by way of the Internet and prints the images on a label sheet material having an adhesive rear surface (S33). At this time, the retail shop or the user may add the name of the user and other additional information to the original pattern. Then, the produced label is affixed to the tool (S34). On the other hand, the manufacturer manufactures covers (S35) and marketed at retail shops (S36) The user who has produced the label purchases the cover and puts the cover on the tool to which the label has been affixed (S34).

Figure 17:
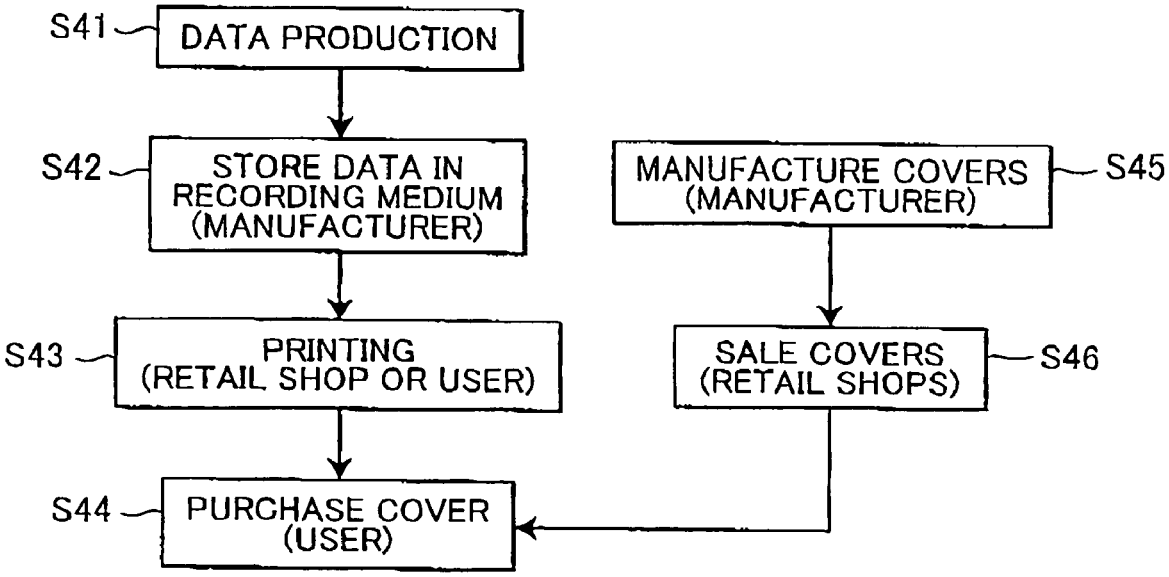
FIG. 17 is a flow chart showing a process for providing a label and a cover for a portable tool according to a third modification to the second embodiment.
Figure 18:
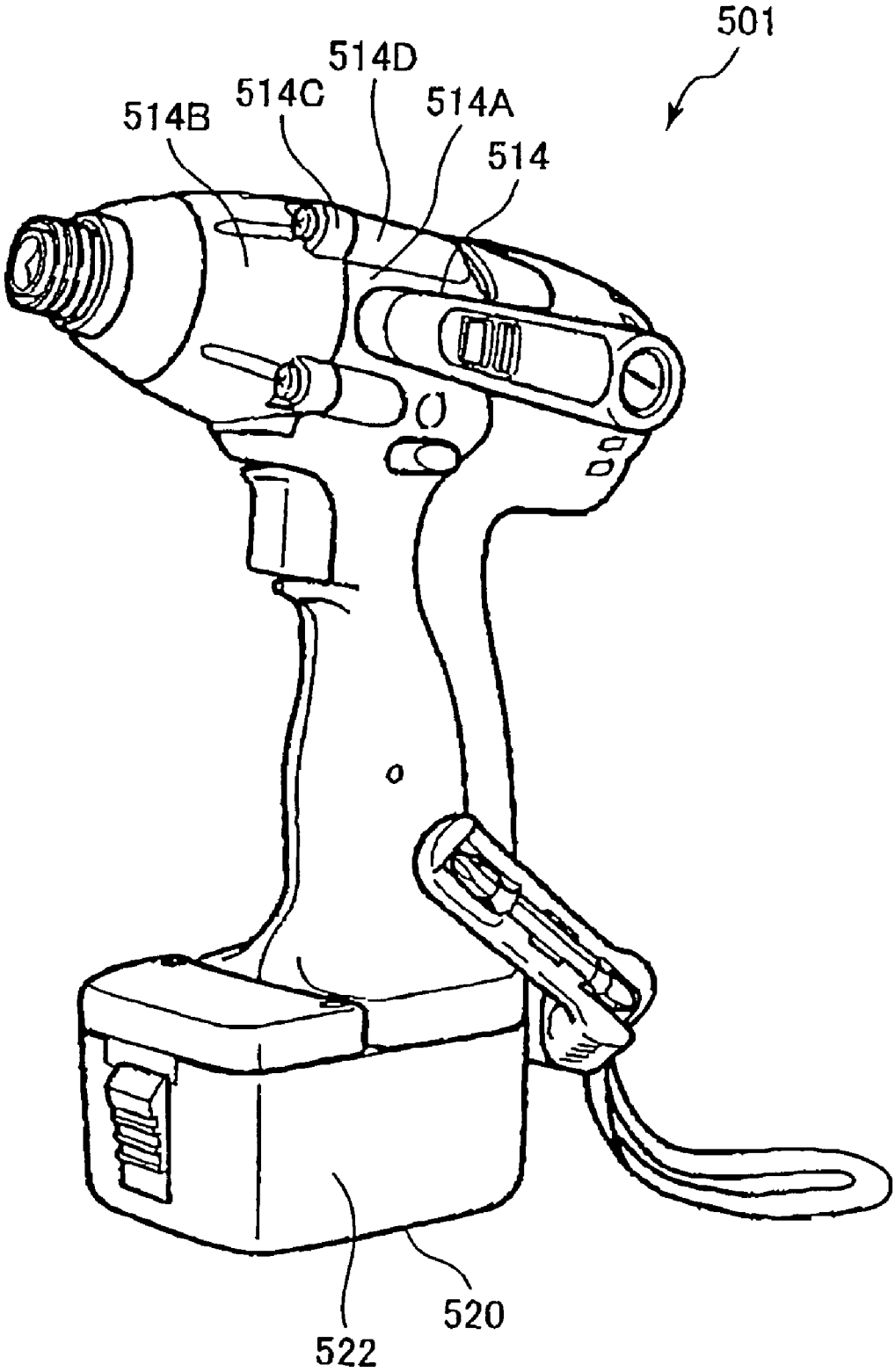
FIG.18 PRIOR ART
FIG. 18 is a perspective view showing a conventional portable tool.
Figure 19:
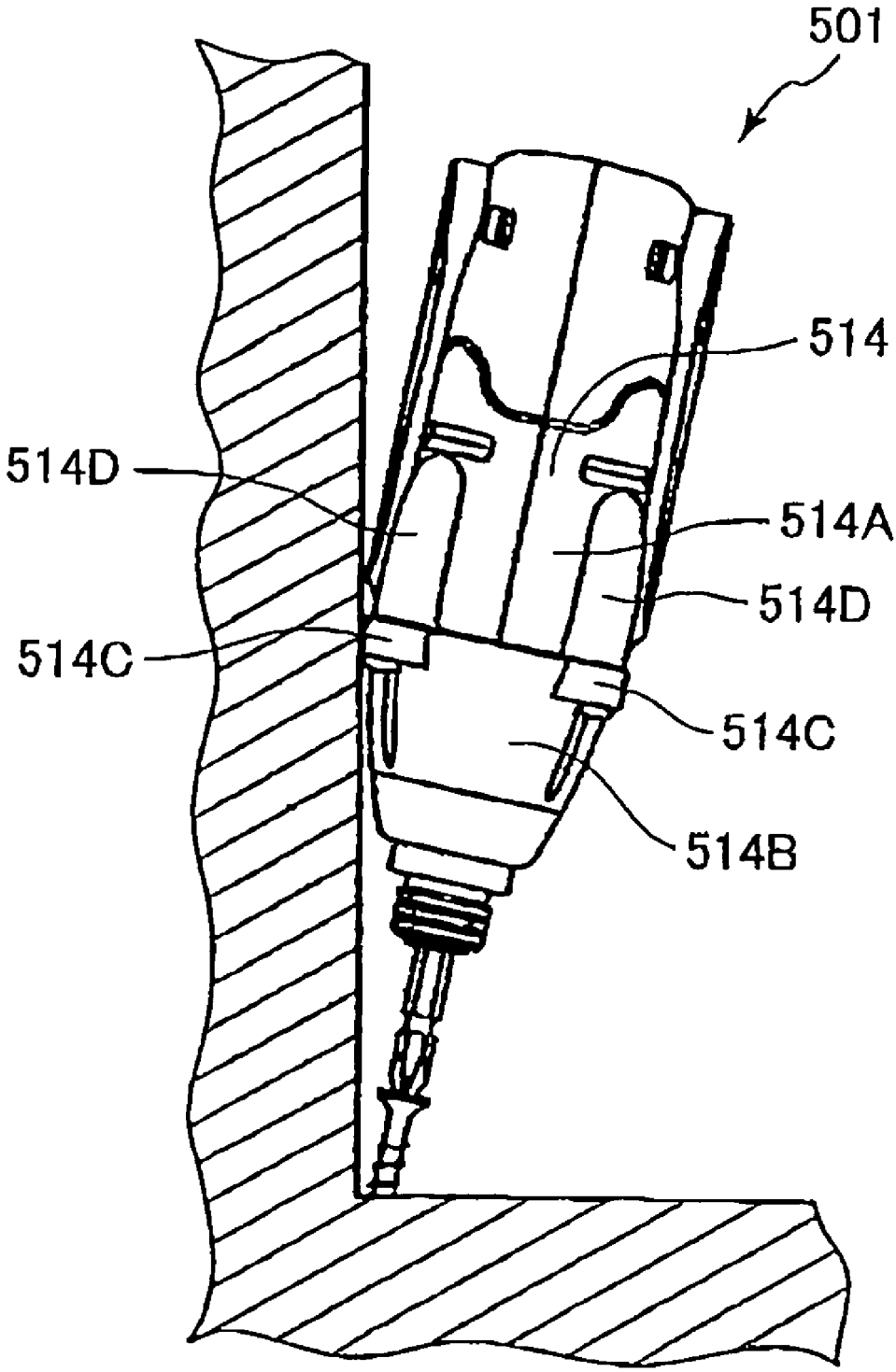
FIG.19 PRIOR ART
FIG. 19 is a side view showing the conventional portable tool that is used for driving a screw near a wall.

As shown in FIG. 17, when the label image data are distributed by way of recording mediums such as CD-ROMs and flexible disks, firstly, the label image data are produced by the manufacturer of portable tools (S41) and, the data are stored in the recording mediums and the mediums are distributed by the manufactures (S42). Then, the retail shop or the user prints the label image on a sheet having an adhesive rear surface, with the data stored in the recording medium (S43). At this time, the retail shop or the user may add the name of the user and other additional information to the original pattern. Then, the thus produced label is affixed to the tool (544). On the other hand, the manufacturer manufactures covers (S45) and the covers are marketed at retail shops (S46). The user who has produced the label purchases the cover and dispose the cover over the portable tool (S44). Similar to the second embodiment, when the data are supplied by the manufacturer by way of the Internet, the manufacturer can provide the data anywhere in the world. Thus users and retail shops can obtain the data immediately and print images to produce a specific label.

The label is ordinarily made from a paper. However, a resin label is also available. Still alternatively, an elastic label that expands and contracts can be used for the material of the label. In the latter case, the label can be affixed snugly to a complicated outer profile portion of the portable tool. If the rear surface is made adhesive, the snugly fitted condition can be maintained for long period of time. If the cover 40 is disposed over the label, the label can hardly be wrinkled nor displaced. Further, the rear surface of the label is not necessarily be adhesive.

Further, in the above-described embodiment, the motive power section 11 is driven by electric power supplied from the battery. However, it may alternatively be driven by an electric power distributed by a commercial power supply.

Further, the cover is transparent in the above-described embodiments. However, a translucent cover is also available as long as the cover permits the inner label to be visible.

Further, the cover 40 is fitted to the hammer case 14B in the first embodiment. However, a cover can be disposed over the outer frame 22 of the battery pack 20, and a label is placed between the outer frame 22 and the cover. With such an arrangement, the user can easily identify the battery pack 20 that is removably assembled to the main body 10 and can easily locate the separate battery pack 20. If the cover is made from a resin, the cover can effectively protect the battery pack 20.

What is claimed is:

1. A portable tool comprising:

a motive power section;

a mechanical section driven by the motive power section;

an outer frame covering at least the motive power section and the mechanical section, the outer frame having an outer peripheral surface on which a label is mountable; and a cover made from a light transmissive material and being removably disposed to the outer frame for protectingly covering an entirety of the label and at least a part of the outer frame;

wherein the outer frame comprises:

an aluminum alloy section provided with a first screw seat protruding radially outwardly from an outer peripheral surface of the aluminum alloy section;

a resin section provided with a second screw seat protruding radially outwardly from an outer peripheral surface of the resin section; and at least one screw connecting the aluminum alloy section to the resin section upon threading engagement with the first screw seat and the second screw seat; and wherein the cover is configured with a fitting section so as to be disposed over the outer frame so as to also cover the first and second screw seats.

2. The portable tool as claimed in claim 1, wherein the cover is made from one of a transparent resin and a translucent resin.

3. The portable tool as claimed in claim 1, wherein the outer frame has a front tapered section with a diameter gradually reduced toward a front end thereof, the label being mounted over the tapered section; and wherein the cover has a hollow cylindrical shape in conformance with an outer profile of the front tapered section, the cover having an inner peripheral surface in contact with the label and a part of the tapered section and fitted to the front tapered section.

4. The portable tool as claimed in claim 3, wherein the front tapered section has a front end, and the portable tool further comprises a front cap immovably positioned at the front end of the tapered section and detachably connected to the front tapered section for preventing the label from being displaced relative to the front tapered section.

5. The portable tool as claimed in claim 1, wherein the label contains information.

6. A combination of a portable tool and a cover:

wherein the portable tool comprises:

a motive power section;

a mechanical section driven by the motive power section; and an outer frame covering at least the motive power section and the mechanical section, the outer frame having an outer peripheral surface on which a label is mountable;

wherein the cover is made from a light transmissive material and removably disposed to the outer frame for covering an entirety of the label and at least a pat of the outer frame;

wherein the outer frame comprises:

an aluminum alloy section provided with a first screw seat protruding radially outwardly from an outer peripheral surface of the aluminum alloy section;

a resin section provided with a second screw seat protruding radially outwardly from an outer peripheral surface of the resin section; and at least one screw connecting the aluminum alloy section to the resin section upon threading engagement with the first screw seat and the second screw seat; and wherein the cover is configured with a filling section disposed over the outer frame so as to also cover the first and second screw seats.

7. The combination as claimed in claim 6, wherein the cover is made from one of a transparent resin and a translucent resin.

8. The combination as claimed in claim 6, wherein the outer frame has a front tapered section with a diameter gradually reduced toward a front end of the portable tool, the label being mounted over the tapered section; and wherein the cover has a hollow cylindrical shape in conformance with an outer profile of the front tapered section, the cover having an inner peripheral surface in contact with the label and a part of the tapered section and fitted to the front tapered section.

9. The combination as claimed in claim 8, wherein the front tapered section has a front end, and the portable tool further comprises a front cap immovably positioned at the front end of the tapered section and detachably connected to the front tapered section for preventing the label from being displaced relative to the front tapered section.

10. The combination as claimed in claim 6, wherein the label contains information.

11. A combination of a portable tool, a cover, and a label;

wherein the portable tool comprises:

a motive power section;

a mechanical section driven by the motive power section; and an outer frame covering at least the motive power section and the mechanical section, and outer frame having an outer peripheral surface;

wherein the label is mountable on the outer peripheral surface of the outer frame;

wherein the cover is made from a light transmissive material and removably disposed to the outer frame for covering an entirety of the label and at least a part of the outer frame;

wherein the outer frame comprises:

an aluminum alloy section provided with a first screw seat protruding radially outwardly from an outer peripheral surface of the aluminum alloy section;

a resin section provided with a second screw seat protruding radially outwardly from an outer peripheral surface of the resin section; and at least one screw connecting the aluminum alloy section to the resin section upon threading engagement with the first screw seat and the second screw seat; and wherein the cover is configured with a fitting section disposed over the outer frame so as to also cover the first and second screw seats.

12. The combination as claimed in claim 11, wherein the cover is made from one of a transparent resin and a translucent resin.

13. The combination as claimed in claim 11, wherein the outer frame has a front tapered section with a diameter gradually reduced toward a front end thereof, the label being mounted over the tapered section; and wherein the cover has a hollow cylindrical shape in conformance with an outer profile of the front tapered section, the cover having an inner peripheral surface in contact with the label and a part of the tapered section and fitted to the front tapered section.

14. The combination as claimed in claim 11, wherein the label is made from one of paper and resin.

15. The combination as claimed in claim 11, wherein the label has an adhesive surface in contact with the outer frame.

16. The combination as claimed in claim 11, wherein the label is one of a plurality of labels printed on a single sheet.

17. The combination as claimed in claim 11, wherein the label contains the information of at least one of a name of a user of the portable tool, at least one color, a pattern, numerals, and a mark.

18. The combination as claimed in claim 11, wherein the label is printed on a basis of data distributed to retail shops of the portable tool or users.

19. The combination as claimed in claim 18, wherein the data are distributed by way of one of Internet and a recording medium.

20. The combination as claimed in claim 11, wherein the label contains an information.

21. A portable tool comprising:

a motive power section;

a mechanical section driven by the motive power section;

an outer frame covering at least the motive power section and the mechanical section, the outer frame including an alloy section and a resin section connected with the alloy section by means of at least one screw, and the outer frame having a surface portion on which a label is mountable; and a cover being removably disposed on the outer frame to cover the surface portion and to cover the at least one screw connecting the alloy section with the resin section.

22. The portable tool as claimed in claim 21, wherein the cover is made from transparent material.

23. The portable tool as claimed in claim 21, wherein the outer frame has a tapered section with a diameter gradually reduced at a front end thereof and the label is mounted on the tapered section.

24. The portable tool as claimed in claim 21, wherein at least one of a character, a numeral and a pattern is printed on the label.

* * * * *